US005358062A

United States Patent [19]

Uhl et al.

[11] Patent Number: 5,358,062

[45] Date of Patent: Oct. 25, 1994

[54] PORTABLE HANDHELD DRILLING APPARATUS

[75] Inventors: Klaus-Martin Uhl, Baltmannsweiler; Hans Nickel, Cottenweiler; Helmut Zimmermann, Kernen; Rudolf Krebs, Backnang; Harald Schliemann, Waiblingen, all of Fed. Rep. of Germany

[73] Assignee: Andreas Stihl, Waiblingen

[21] Appl. No.: 98,891

[22] Filed: Jul. 29, 1993

[30] Foreign Application Priority Data

Jul. 29, 1992 [DE] Fed. Rep. of Germany ... 9210140[U]
Jul. 10, 1993 [DE] Fed. Rep. of Germany ..... 4323126

[51] Int. Cl.[5] ..... E21B 10/44

[52] U.S. Cl. ..... 175/394; 173/178; 188/77 R

[58] Field of Search ..... 175/394; 173/178, 176, 173/172; 188/77 R, 77 W, 166

[56] References Cited

U.S. PATENT DOCUMENTS 3,318,390 5/1967 Hoza et al. ..... 173/178
3,724,560 4/1973 Tibbott ..... 173/178
4,458,565 7/1984 Zilly et al. ..... 173/178 X
4,871,033 10/1989 Odoni et al. ..... 188/166 X
5,085,280 2/1992 Rassieur ..... 173/176
5,090,490 2/1992 Block ..... 173/171

*Primary Examiner*—William P. Neuder
*Attorney, Agent, or Firm*—Walter Ottesen

[57] ABSTRACT

The invention directed to a portable handheld drilling apparatus for receiving and driving a drill which can encounter a drilling resistance during a drilling operation thereby causing the drilling apparatus to undergo an unwanted rotational movement. The drilling apparatus of the invention includes: a handle for holding by an operator while performing the drilling operation; a drive motor; a transmission for driving the drill; a centrifugal clutch assembly mounted between the drive motor and the transmission; a brake device movable between an inactive position and a braking position; a trigger lever movable between a first position wherein the trigger lever is at rest and a second position; the trigger lever being operatively connected to the brake device so as to trip the brake device into the braking position when the trigger lever moves from the first position into the second position; and, an actuating device for acting upon the trigger lever to cause the trigger lever to move into the second position when the unwanted rotational movement exceeds a pregiven limit value.

15 Claims, 5 Drawing Sheets

PORTABLE HANDHELD DRILLING APPARATUS

FIELD OF THE INVENTION

The invention relates to a drilling apparatus guided by hand and including a guide handle, drive motor, transmission and a centrifugal clutch disposed between the motor and the transmission.

BACKGROUND OF THE INVENTION

Portable handheld drilling apparatus of this kind have the disadvantage that unexpected torque increases can occur when the auger encounters resistances in the drill hole such as stones, roots or the like. These unexpected torque increases can lead to a sudden reduction of rpm of the auger or even cause the auger to become blocked or jammed. The braking torque occurring thereby must be taken up by the operator via the guide handle and this can lead to a considerable safety risk since the operator can lose his hold on the apparatus and be injured thereby.

SUMMARY OF THE INVENTION

It is an object of the invention to provide a drilling apparatus of the kind described above which is improved so that the above disadvantages are avoided and the safety risk is eliminated by simple means in a reliable manner.

The invention is a portable handheld drilling apparatus for receiving and driving a drill which can encounter a drilling resistance during a drilling operation thereby causing the drilling apparatus to undergo an unwanted rotational movement.

The drilling apparatus of the invention includes: a handle for holding by an operator while performing the drilling operation; a drive motor; a transmission for driving the drill; a centrifugal clutch assembly mounted between the drive motor and the transmission; a brake device movable between an inactive position and a braking position; a trigger lever movable between a first position wherein the trigger lever is at rest and a second position; the trigger lever being operatively connected to the brake device so as to trip the brake device into said braking position when the trigger lever moves from said first position into said second position; and, actuating means for acting upon said trigger lever to cause the trigger lever to move into said second position when the unwanted rotational movement exceeds a pregiven limit value.

According to a feature of the invention, the trigger lever as well as a brake device, which operates together with the trigger lever, are provided. The trigger lever and the brake device are operatively connected in such a manner that the trigger lever releases the brake device when the drill such as an auger encounters a drilling resistance and a pregiven limit value of an unintended rotational movement of the drilling apparatus occurs. The trigger lever is then advantageously journalled on a carrier housing against the holding force of a position spring.

In one embodiment, the trigger lever can be provided with an inertial mass which is so dimensioned that the holding force is overcome and the braking action is initiated when a limit value of a suddenly occurring unwanted rotational acceleration of the drilling apparatus is exceeded. The holding force holds the trigger lever in its at-rest position, that is, in the disengaged position of the brake device. The limit value is a pregiven magnitude of the angular acceleration which occurs with the rotation of the drilling apparatus as a consequence of the auger encountering a drilling resistance.

In another embodiment, the trigger lever having an inertial mass can be connected to a further trigger lever which is preferably in the form of a lever rod which, as an extension of the trigger lever associated with the inertial mass, can extend laterally beyond the drilling apparatus. The rod-like additional trigger lever is then likewise journalled against the holding force of a position spring on the carrier housing. In such an embodiment, the brake device can be released when the magnitude of a pregiven angular acceleration or angle magnitude is exceeded, namely, when the rod-shaped trigger lever strikes the operator.

In a third embodiment of the invention, the brake device can only be triggered when the rod-shaped trigger lever passes through an angular quantity when the drilling apparatus rotates because the auger encounters a drilling resistance. The trigger lever extends laterally beyond the drilling apparatus and the angular value is determined by the blow imparted to the operator. In this embodiment, the trigger lever can be formed by a lever rod of comparatively low mass.

A torque increase acts on the drilling apparatus equipped with a guide handle when the auger encounters resistance in the drilling hole. The safety brake device according to the invention instantly prevents this torque increase by braking the drum of the centrifugal clutch. The drive torque is taken up by the brake band so that a rotation of the drilling apparatus and therefore a risk of danger to the operator is avoided.

In a simplified embodiment of the invention, the carrier housing of the brake device includes at least one of the following components: brake band, position spring, tension spring, toggle-lever joint as well as a pivoted trigger lever having an inertial mass and/or a rod-like trigger lever. The parts conjointly define the brake device. In an advantageous configuration, this brake device can be configured as an independent intermediate piece which is so configured that it can be mounted between the drive motor and the transmission of the drilling apparatus in a simple manner.

Such a flange-like configuration of the brake device affords the advantage that the structural complexity can be held to a minimum and constructive changes of the remaining components of such a drilling apparatus are not necessary. Furthermore, already existing drilling apparatus can be retrofitted simply and quickly with the safety device configured as an intermediate piece.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
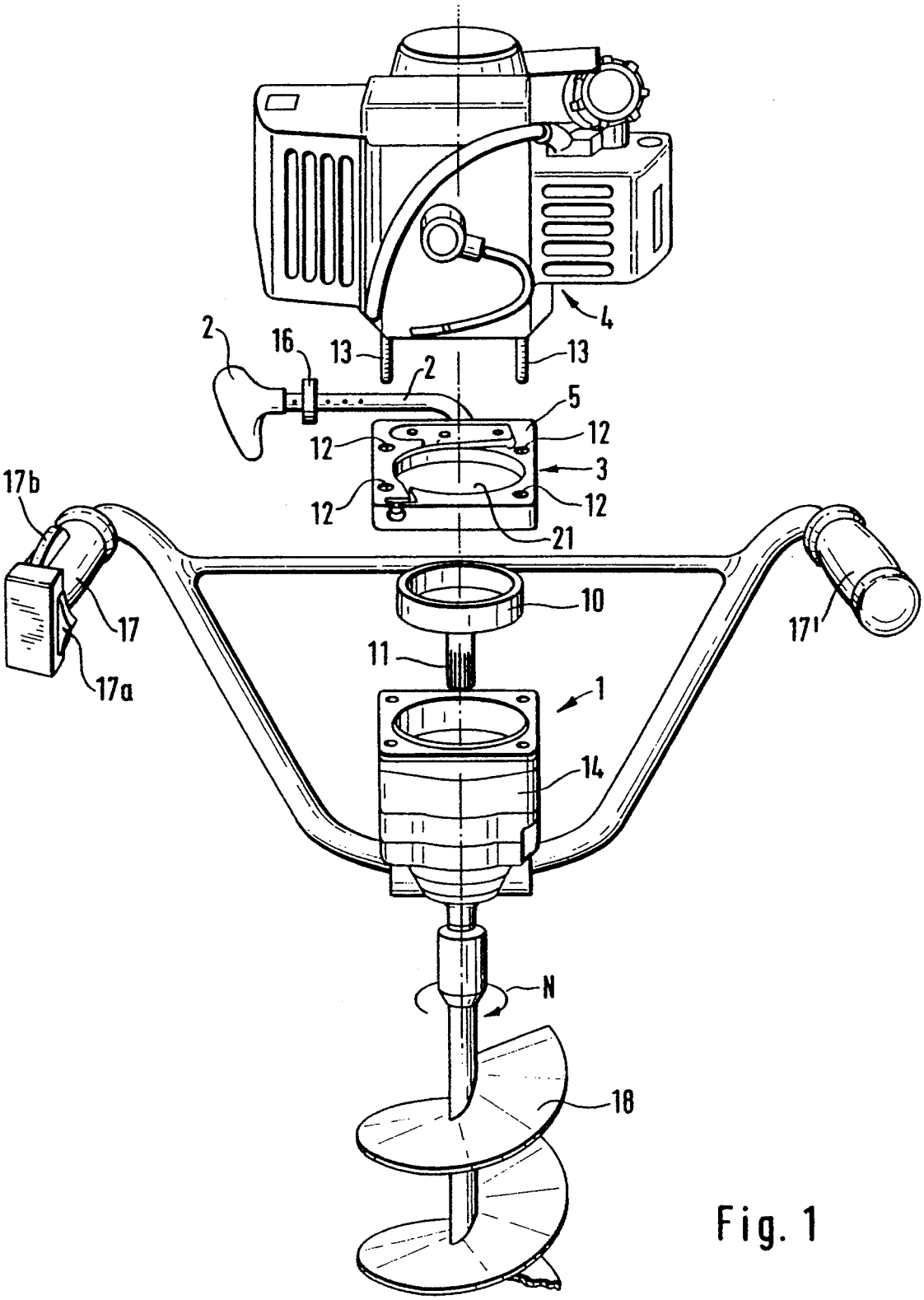
FIG. 1 depicts a complete drilling apparatus with a first embodiment of a safety brake device shown in exploded illustration.

The illustrated embodiments show a hand-guided drilling apparatus equipped with guide handles (17, 17'), a drive motor 4 having a transmission 14 as well as a centrifugal clutch 1 disposed between the motor 4 and the transmission 14. The centrifugal clutch 1 includes a clutch drum 10 and a drive pinion 11. The operator guides this drilling apparatus from a location which is rearward of the plane of the drawing of FIG. 1. With the right hand, the operator holds the handle 17 lying to the left in the drawing. The required switch 17*a* and throttle lever 17*b* are arranged on the handle 17 as shown.

According to the invention, a trigger lever 2 (see FIGS. 1 to 3) as well as a safety brake device 3 are provided on the drilling apparatus. The safety brake device 3 is operatively connected to the trigger lever 2. An unwanted rotational movement of the drilling apparatus can occur when the auger encounters a resistance in the drilling hole such as stones, roots or the like. The trigger lever 2 and the brake device 3 are operatively connected to each other in such a manner that the brake device 3 is triggered when a pregiven limit value of this unwanted rotational movement is reached.

For this purpose, the trigger lever 2 is movably journalled against the holding force of a position spring 7 in such a manner that the trigger lever has a limited switching path.

In the embodiment of FIG. 1, the trigger lever 2 has a predetermined inertial mass whose magnitude is so dimensioned that this mass overcomes the holding force of the inertially-encumbered trigger lever 2 (when the rotational acceleration of the drilling apparatus exceeds a limit value) and triggers the brake.

In the embodiment of FIG. 1, the trigger lever is provided with an adjustable inertial mass 16 such that the magnitude of the angular acceleration at which the trigger lever 2 is intended to trigger the brake device 3 can be adjusted.

The trigger lever 2 has a short switching path with respect to the brake device 3 and especially with respect to the carrier housing 5 of the brake device 3. The short switching path of the trigger lever 2 is such that the lever 2 moves into the braking position when the limit value of the angular acceleration is reached and can again be returned manually by the operator into the initial position in which the brake device is disengaged.

With the arrangement according to the invention, the auger 18 is braked up to idle at a pregiven acceleration limit value of the torque increase when the auger 18 encounters a drilling resistance so that a further rotation of the drilling apparatus and therefore a possible injury of the operator is avoided.

Figure 3:
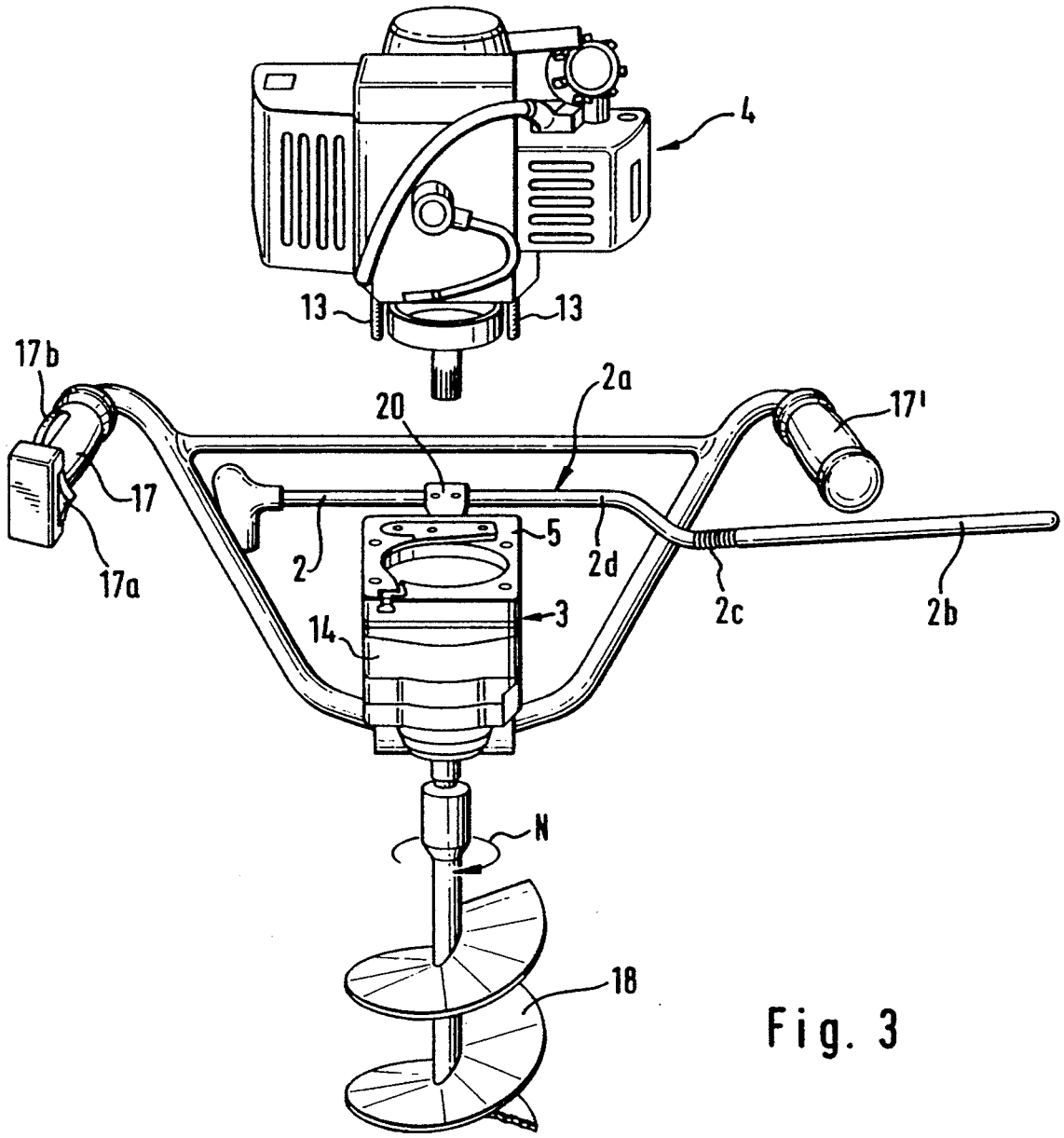
FIG. 3 is a second embodiment of the safety device equipped with an additional lever rod for the trigger lever.

In the embodiment of FIG. 3, the trigger lever 2 has no additional inertial mass 16 and is provided with an additional trigger lever 2*a* in the form of a lever rod projecting laterally beyond the drilling apparatus. The trigger lever 2*a* is connected at a pivot location 20 on the carrier housing 5. The lever rod is likewise biased by the holding force of the position spring 7 and has a corresponding switching path for triggering the brake. The brake is triggered when a drilling resistance is encountered and the drilling apparatus is rotated and in this way the free end of the trigger lever 2*a* strikes the operator and triggers the brake because of a short further rotation of the drilling apparatus. The limit value is here the magnitude of the angle which the trigger lever 2*a* passes through with a rotation of the drilling apparatus up to its stop on the operator.

If the auger 18 rotates in the clockwise direction (arrow N), then, when the drill encounters a resistance, the drilling apparatus will rotate in the opposite direction because of the reaction force (that is, in the counterclockwise direction) by a specific angle magnitude with the trigger lever 2*a* also rotating. When the operator is struck, the trigger lever 2*a* must only pass through the switching path until the brake is released. The switching path is determined by the dimensioning of the position spring 7.

When the rotation of the drilling apparatus has stopped and the auger runs at idle, the operator must then return the trigger lever 2*a* in order to release the brake action.

This can take place in that the operator pulls the trigger lever toward himself through the switching path so that the trigger lever again assumes its initial position, namely, the unbraked position. However, the operator can also bring about this initial position in that the operator returns the trigger lever into its initial position since the trigger levers 2 and 2*a* are rigidly connected to each other. The trigger lever 2 is provided with a handle.

The embodiment of FIG. 3 can be so configured that the trigger lever 2, which has no additional displaceable inertial mass, can nonetheless release the brake with its inertial torque. An additional trigger action with a blow of the trigger lever 2*a* on the operator is possible with the trigger lever 2*a* being provided additionally.

Figure 4:
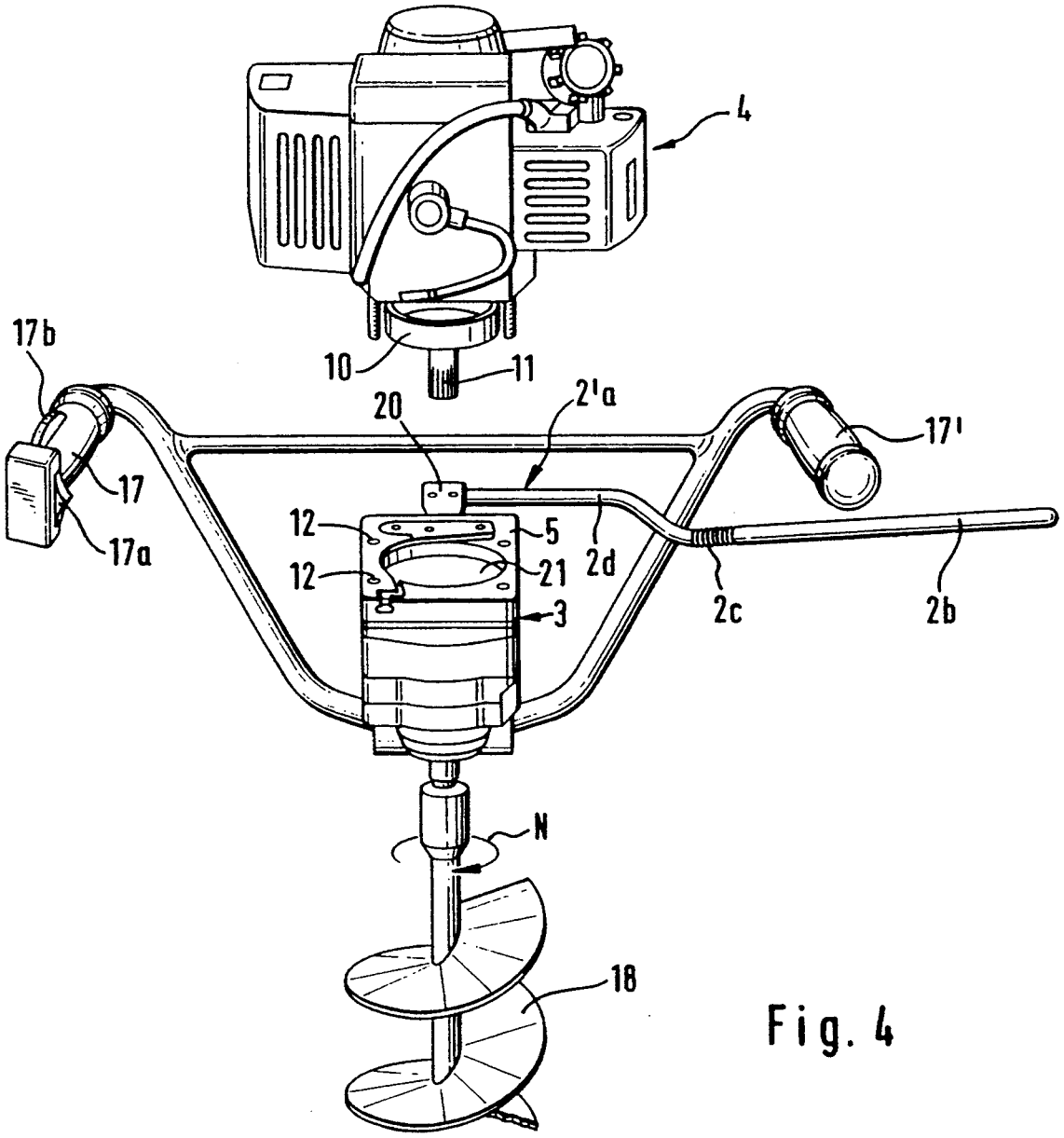
FIG. 4 is a third embodiment wherein the brake device is triggered only by a lever rod operating as the triggering lever without a special inertial mass; and, FIG. 5 shows the configuration of a safety brake device suitable for all embodiments with this view being a radial section view taken through the carrier housing.

In the third embodiment according to FIG. 4, the trigger lever 2*a* of FIG. 3 is configured as a lever rod 2'*a* which has relatively low mass. The lever rod 2'*a* releases the braking action in the manner described with a blow to the body of the operator. The trigger lever 2'*a* therefore likewise projects beyond the drilling apparatus so that this lever can strike the operator when an unwanted rotation of the drilling apparatus occurs and release the brake device 3.

The trigger levers 2*a* and 2'*a* can advantageously have a joint 2*c* as shown in FIGS. 3 and 4. This joint can be, for example, defined by a coil spring. The joint 2*c* can be such that the outer segment 2*b* of the trigger lever 2*a* can yield when striking the operator. In this way, injuries caused by the lever-like configured trigger lever 2*a* or 2'*a* are precluded. At the same time, this lever is protected against damage during use since the joint permits a deflection during transport and can be brought into a protected rest position.

In addition, it is understood that the joint 2*a* itself can be configured so as to be so stiff that the trigger lever 2*a* or 2'*a* can as a unit transmit the necessary displacement force when striking an operator to release the brake device. In this case, the trigger lever 2*a* or 2'*a* transmits the displacement force as a unit, that is, including its outer segment 2*b*.

All three embodiments have in common the assembly of the safety brake device 3 according to which this brake device is configured as a flange-like intermediate piece. This intermediate piece includes a carrier housing 5 into which all components necessary for the brake function are accommodated and it is therefore configured as a compact independent component which requires little space and therefore does not substantially change the drilling apparatus with respect assembly and weight. The intermediate piece can be advantageously built into new as well as into already available drilling apparatus. For this purpose, the safety brake device 3 (that is, the intermediate piece) is simply attached between the motor 4 and the transmission 14. Attachment elements 12 can, for example, be bores and the attachment parts 13 can, for example, be screws or stud bolts.

Figure 5:
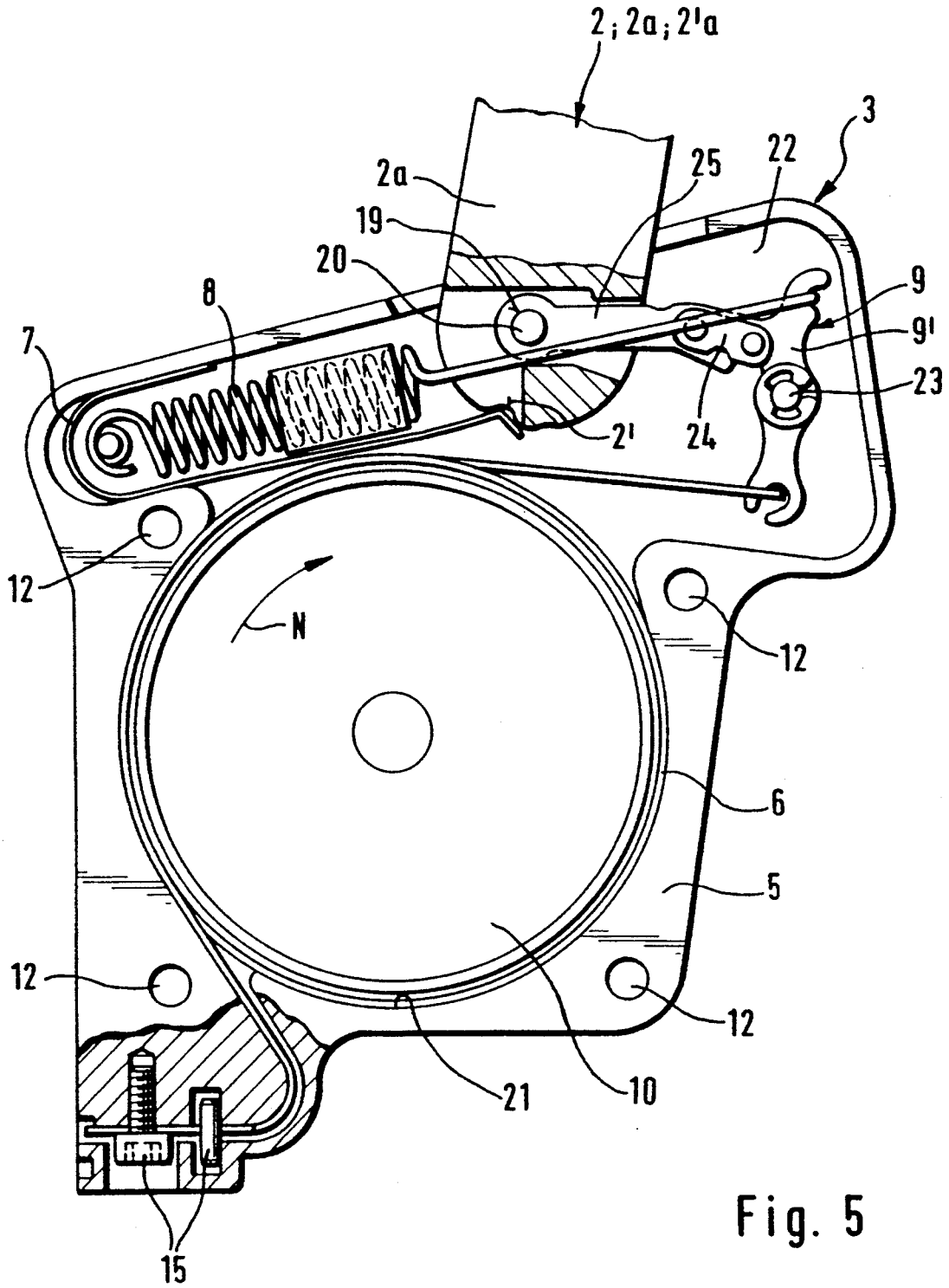

In all embodiments, the trigger lever 2 or 2*a* or 2′*a* is pivotally journalled by means of the bolt 20 guided in the bore 19 with a limited switching path. The position spring 7 engages in a latch recess 2′ (see FIG. 5) of the trigger lever (2 or 2′ or 2′*a*) and holds this lever in the position in which the brake is disengaged. The holding force of the spring 7 is then so dimensioned that it can be overcome by the critical acceleration force in the embodiment of FIG. 1 or by the switching path of the trigger lever 2*a* or 2′*a* in FIGS. 3 and 4, respectively. In all embodiments, the carrier housing 5 encloses the clutch drum 10 of the centrifugal clutch 1 with the clutch drum 10 being provided with a drive pinion 11 which provides a positive connection to the transmission 14.

The arrangement is further so made that the clutch drum 10 is enclosed by the brake band 6 almost completely and preferably several times. The brake band 6 is attached at 15 in the carrier housing 5 at one end; whereas, the other end of the brake band 6 is operatively connected to the trigger lever 2 and the tension spring 8 via the toggle-lever joint 9. As already mentioned, the compact configuration of the safety brake device 3 is achieved in that it has a carrier housing 5 adapted to the motor housing or to the transmission wherein all essential elements are accommodated, namely, the brake band 6, position spring 7, tension spring 8 and toggle-lever joint 9. In this connection, and as shown in the drawings, the arrangement can be so made that a recess 22 is provided which lies eccentrically to a recess 21. The recess 21 is almost approximately circular and is in the carrier housing 5. The additional spring 8, the toggle-lever joint 9, the position spring 7 and a bent-over end portion 2″ of the trigger lever 2 with a pivot pin 20 are provided in the recess 22. The toggle-lever joint 9 can be configured in a suitable manner. In the embodiment shown, the toggle-lever joint 9 is configured as a two-arm lever pivotable on the pivot pin 23.

The two-arm lever 9′ of the toggle-lever joint 9 receives the end of the tension spring 8 and is connected to pivot pin 20 via a link plate 24 and an intermediate lever 25. The other end of the two-arm lever 9′ is provided with an appropriate cutout and the free end of the brake band 6 is hooked in this cutout.

Figure 2:
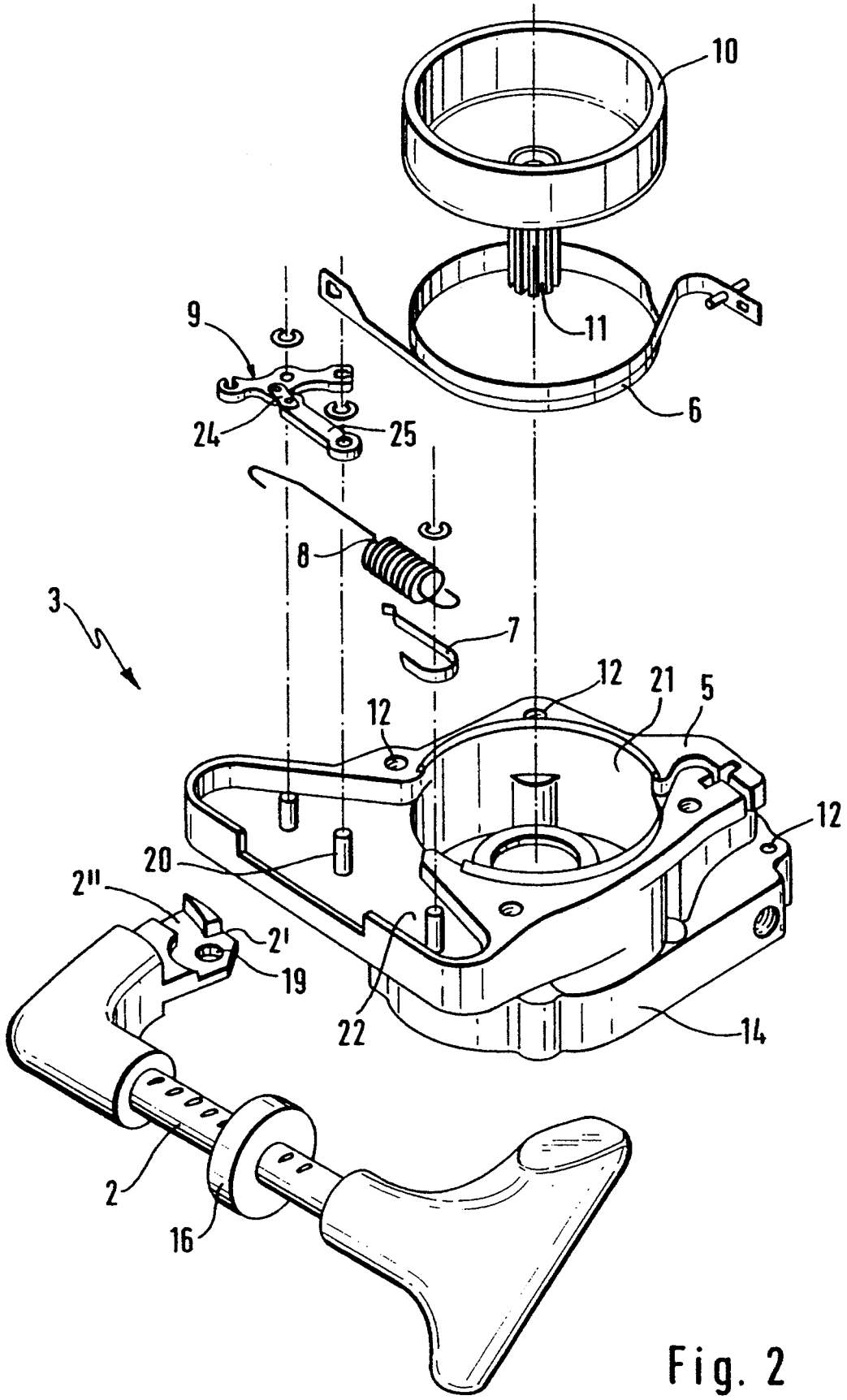
FIG. 2 is an exploded view of the brake device of FIG. 1 integrated into the housing of the transmission of the drilling apparatus.

The safety brake of FIGS. 1 to 3 can be tripped by bracing the trigger lever 2 on the operator as a consequence of a rotation of the drilling apparatus relative to the person as well as automatically with the sudden occurrence of an angular acceleration of the drilling apparatus which exceeds a limit value wherein the trigger lever 2 triggers the braking operation because of its inertial mass. The sensitivity of the triggering can be adjusted in that the inertial mass 16 is shifted on the trigger lever 2. With the triggering of the brake operation, the toggle-lever joint 9 is moved beyond its dead point so that the tension spring 8 causes the brake band 6 to become taut and wrap around the clutch drum 10 of the centrifugal clutch in a force-tight manner. The direction of rotation of the clutch drum 10 and of the drive pinion 11 connected to the drum is shown in the drawings by the arrow N and is such that a self-amplification (that is, a power braking) is effected between the brake band 6 and the clutch drum 10.

If a resistance is encountered by the auger 18 during the operation of the drilling apparatus of the embodiment shown in FIGS. 1, 3 and 4, which brakes the auger or even brings it to standstill, then as already described, the parts of the drilling apparatus including the guide handle 17 rotate about the axis of the auger in a direction opposite to the rotational direction N of the auger with an angular acceleration occurring.

In the embodiment of FIG. 1, the movable trigger lever 2 in this instant at first retains its set position because of its inertial mass and then finally follows the angular acceleration with delay. The relative movement which occurs thereby between the carrier housing 5 and the trigger lever 2 is utilized in the drilling apparatus with inertial mass (see FIG. 1) to trigger the braking operation. In the embodiments of FIGS. 3 and 4, the braking operation is triggered by the trigger lever 2*a* or 2′*a* which projects laterally beyond the drilling apparatus when these levers strike against the operator after a pivot movement of the entire drilling apparatus is completed.

The toggle-lever joint 9 provided in the carrier housing 5 passes through its dead-point position during the tripping operation thereby causing the tension spring 8 to apply the brake band 6 on the clutch drum 10 and, in this way, the housing parts which have undergone movement are braced via the brake band 6 on the more or less locked auger 18 so that the operator must no longer develop a holding torque and is not in danger while the motor 4 can continue to rotate in idle. Braking operations of the auger are a consequence of drilling resistance which is encountered. The advantage of the invention during these braking operations is seen in that the relative movement between the drive motor 4 with the transmission 14 and the auger 18 is prevented automatically without intervention by the operator. In this way, the operator is protected against suddenly occurring reaction forces on the drilling apparatus without it being necessary to bring the drive motor of the drilling apparatus itself to standstill.

All of the embodiments disclosed include a configuration wherein the intermediate piece 3 is structurally integrated into the housing of the transmission 14 in such a manner that the intermediate piece and the transmission housing define a single component. The arrangement is then advantageously so configured that the structural length of the transmission must not be increased so that at the same time, a simple exchange of the integrated transmission housing including the intermediate piece containing therein the safety brake device is possible. An increase of the structural length of the housing of the transmission 14 is avoided in that, in the embodiment of FIG. 2, the brake band 6 is applied only about the brake drum 10 journalled in the transmission housing and the transmission housing is so configured that the remaining parts of the brake device, namely, position spring 7, tension spring 8, toggle-lever joint 9 and the inertial mass 2 are accommodated in a housing addition laterally displaced relative to the actual housing of the transmission 14. In this way, the transmission housing including a flange-like intermediate piece can be produced as a single component in a simple and inexpensive manner without it being necessary to extend the axial length of the transmission housing.

It is understood that the foregoing description is that of the preferred embodiments of the invention and that various changes and modifications may be made thereto without departing from the spirit and scope of the invention as defined in the appended claims.

What is claimed is:

1. A portable handheld drilling apparatus for receiving and driving a drill which can encounter a drilling resistance during a drilling operation thereby causing said drilling apparatus to undergo an unwanted rotational movement, the drilling apparatus comprising:

a handle for holding by an operator while performing the drilling operation;

a drive motor;

a transmission for driving the drill;

a centrifugal clutch assembly mounted between said drive motor and said transmission;

a brake device movable between an inactive position and a braking position;

a trigger lever movable between a first position wherein said trigger lever is at rest and a second position;

said trigger lever being operatively connected to said brake device so as to trip said brake device into said braking position when said trigger lever moves from said first position into said second position; and, actuating means for acting upon said trigger lever to cause said trigger lever to move into said second position when said unwanted rotational movement exceeds a pregiven limit value.

2. The portable handheld drilling apparatus of claim 1, said rotational movement being accompanied by an angular acceleration and said limit value being a limit value of said angular acceleration, said actuating means comprising:

holding means for holding said trigger lever in said first position with a predetermined holding force; and, an inertial mass mounted on said trigger lever and having a magnitude selected to overcome said holding force when said limit value of angular acceleration is reached thereby causing said trigger lever to move into said second position and release said brake device.

3. The portable handheld drilling apparatus of claim 2, said trigger lever defining a longitudinal axis; and, said actuating means further comprising shifting means for permitting said inertial means to be shifted along said axis.

4. The portable handheld drilling apparatus of claim 1, further comprising:

holding means for holding said trigger lever in said first position with a predetermined holding force;

a carrier housing mounted between said drive motor and said transmission; and, said trigger lever being pivotally mounted in said carrier housing and said holding means including a position spring for resiliently holding said trigger lever in said first position.

5. The portable handheld drilling apparatus of claim 4, said centrifugal clutch including a clutch drum operatively connected to said transmission and being rotatably mounted in said carrier housing; and said brake device including;

a brake band disposed in surrounding relationship to said clutch drum;

a tension spring for pulling said brake band tight around said clutch drum when said brake device is in said braking position; and, a toggle-lever joint connected to said tension spring and pivotally mounted in said carrier housing so as to coact with said trigger lever to release said tension spring to pull said brake band-tight against said drum when said trigger lever is moved into said second position.

6. The portable handheld drilling apparatus of claim 1, said trigger lever rotating through an angle of rotation during said unwanted rotational movement until said trigger lever strikes the operator; and, said limit value being said angle of rotation.

7. The portable handheld drilling apparatus of claim 4, said actuating means comprising:

a lever rod defining an additional trigger;

said lever rod being connected to said trigger lever where said trigger lever is pivotally mounted in said carrier housing; and, said lever rod extending laterally out from said drilling apparatus to strike the operator in the course of said unwanted rotational movement thereby causing said brake device to move into said braking position.

8. The portable handheld drilling apparatus of claim 1, said actuating means being an extension lever extending from said trigger lever to project laterally beyond said drilling apparatus so as to strike the operator in the course of said unwanted rotational movement thereby causing said trigger lever to move into said second position and trip said brake device.

9. The portable handheld drilling apparatus of claim 8, said actuating means further comprising resilient joint means for connecting said extension lever to said trigger lever thereby permitting said extension lever to yield relative to said trigger lever.

10. The portable handheld drilling apparatus of claim 4, said carrier housing being an independent intermediate piece; and, said drilling apparatus further comprising attachment means for flange connecting said intermediate piece to said drive motor and to said transmission.

11. The portable handheld drilling apparatus of claim 5, said clutch drum having a pinion formed thereon and said pinion being in positive engagement with said transmission; said brake band having first and second ends; and, means for attaching said first end of said brake band to said carrier housing and said second end of said brake band being attached to said toggle-lever joint.

12. The portable handheld drilling apparatus of claim 11, said holding means including a leaf spring mounted in said carrier housing; said leaf spring having first and second ends; said first end of said leaf spring being braced against said carrier housing and said second end of said leaf spring being connected to said toggle-lever joint; and, said tension spring having first and second ends, said first end of said tension spring being connected to said carrier housing and said second end of said tension spring being connected to said toggle-lever joint.

13. The portable handheld drilling apparatus of claim 12, said trigger lever having an end piece; said carrier housing including a first recess having an approximately circular configuration and a second recess eccentric to said first recess; said second recess being disposed in said carrier housing so as to adjoin said first recess; said tension spring, said toggle-lever joint, and said leaf spring all being disposed in said second recess; and, said carrier housing including a pivot pin provided in said second recess and said end piece of said trigger lever being pivotally mounted on said pivot pin.

14. The portable handheld drilling apparatus of claim 13, said transmission having a transmission housing and said carrier housing and said transmission housing conjointly defining a single housing.

15. The portable handheld drilling apparatus of claim 14, said single housing having a portion thereof projecting laterally from the remainder of said single housing; and, said second recess being formed in said portion of said single housing.

* * * * *